United States Patent [19]

Schaedlich et al.

[11] Patent Number: 4,551,406

[45] Date of Patent: Nov. 5, 1985

[54] ELECTROPHOTOGRAPHIC RECORDING PROCESS AND PHOTOCONDUCTIVE COATING SUITABLE FOR USE THEREIN

[75] Inventors: Günther Schaedlich; Roland Moraw, both of Wiesbaden, Fed. Rep. of Germany

[73] Assignee: Hoechst Aktiengesellschaft, Frankfurt am Main, Fed. Rep. of Germany

[21] Appl. No.: 463,565

[22] Filed: Feb. 3, 1983

[30] Foreign Application Priority Data

Feb. 8, 1982 [DE] Fed. Rep. of Germany ..... 3204221

[51] Int. Cl.[4] ..... G03G 13/10

[52] U.S. Cl. ..... 430/119; 355/10; 355/3 DR; 430/56; 430/126

[58] Field of Search ..... 355/3 R, 3 DR, 10; 430/56, 126, 119

[56] References Cited

U.S. PATENT DOCUMENTS

| | | | |
|---|---|---|---|
| 3,399,060 | 8/1968 | Clancy | 430/56 X |
| 3,801,315 | 4/1974 | Gundlach et al. | 430/56 X |
| 4,076,564 | 2/1978 | Fisher | 430/56 X |

*Primary Examiner*—Fred L. Braun

*Attorney, Agent, or Firm*—Schwartz, Jeffery, Schwaab, Mack, Blumenthal & Evans

[57] ABSTRACT

Method and apparatus for electrophotographically utilizing a textured photoconductor coating and a coating carrier. Textured surface of coating can be produced by placing a textured pattern on the coating directly, or on the coating carrier. In the latter case, the pattern on the coating corresponds to that of the underlying carrier. The coating is electrostatically charged and exposed to produce an image thereon. The image is rendered visible by a liquid developer and transferred to a copy carrier. The photoconductive coating is thereafter freed from toner residues and residual charges.

3 Claims, 4 Drawing Figures

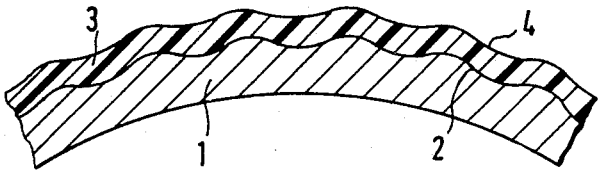
FIG.1
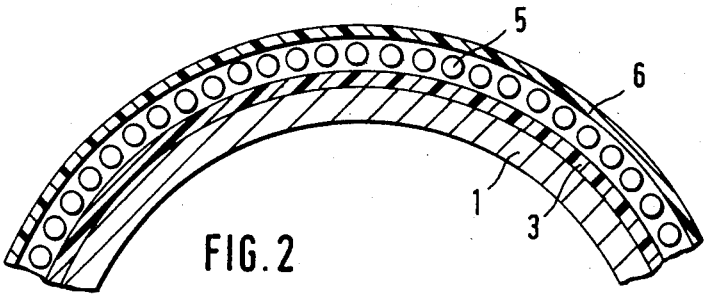
FIG.2
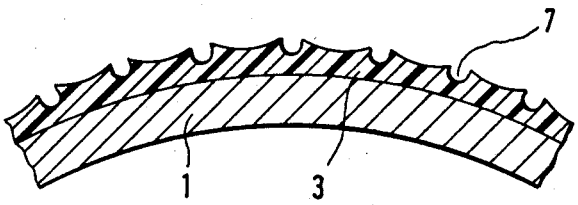
FIG.3
FIG.4
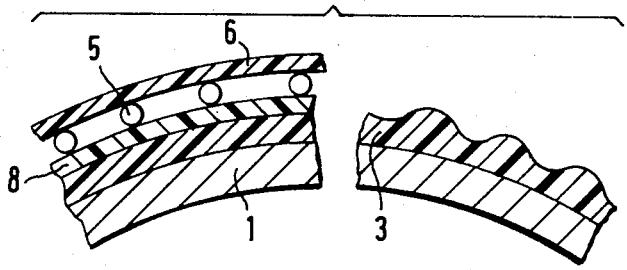

ELECTROPHOTOGRAPHIC RECORDING PROCESS AND PHOTOCONDUCTIVE COATING SUITABLE FOR USE THEREIN

This invention relates to an electrophotographic recording process, in which a photoconductive coating on an electrically conducting coating carrier is electrostatically charged, and exposed in a manner whereby an image is generated thereon. The charge image thus generated is rendered visible by means of a liquid developer, the deposited toner image is transferred to a copy carrier and the photoconductive coating is thereafter freed from toner residues and residual charges. The invention also relates to a photoconductive coating which is suitable for use in this recording process.

In the technology of electrophotographic copying, a photoconductive coating on an electrically conducting coating carrier is electrostatically charged, and exposed in a manner whereby an image is generated thereon. The latent charge image, thus formed, is developed by means of toner particles which have been charged by triboelectricity. In one embodiment which is in widespread use, the charged toner particles are dispersed in a highly insulating dielectric liquid possessing a resistivity in excess of $10^9$ OHm$\times$cm and a dielectric constant of less than 3, such as a mixture of aliphatic hydrocarbons. These dispersions are termed liquid developers. The toner images are transferred, from the photoconductive coating, onto the copy carrier, such as paper. The photoconductive coating is then cleaned, in order to free it of toner residues and residual charges, for the next copying cycle. For this cyclic copying technique, the photoconductive coatings are expediently employed on metallic coating carriers, such as metal drums, or on metallized coating carriers, such as endless belts, composed of thin plastic sheet, such as thin polyester sheet, onto which metal has been vapor deposited.

A disadvantage of developing processes employing liquid developers is that they involve the drag-out of dispersing liquid. During the operation of transferring the toner image, the copy carrier is moistened with dispersing liquid and must be dried. Even if the liquids making up the dispersions are not toxic, the vapors thereof nevertheless pollute the environment.

An effective measure for reducing the drag-out of dispersing liquid takes the form of allowing a roller to rotate in opposite direction to the photoconductive coating, which is wetted by liquid developer, at a small distance of approximately 50 $\mu$m, from the coating (U.S. Pat. No. 3,907,423). Although this known measure already brings about a marked reduction in the drag-out of dispersing liquid, a still more substantial reduction is desired in the interest of lower environmental pollution.

It has already been proposed, moreover, in U.S. Pat. No. 4,478,924 issued Oct. 23, 1984, in a process for transferring a pigment image from a charge image carrier onto a copy carrier, with the aid of an electric field, this pigment image having been produced by treating an electrostatic charge image with liquid developer, to carry out the operation of transferring the layer of liquid developer across an air gap, forming a small clearance, the distribution of pigment, on the layer of liquid developer, being configured in a manner corresponding to the image. The gap is established either by spacers, in the form of films which move with the charge image carrier and the copy carrier, or which are located between them in a stationary arrangement, these films covering up to 10 percent of the area of the copy carrier, or is established by particles which are bonded to the surface of the copy carrier.

The positioning of a film in the interspace between the charge image carrier and the copy carrier, or furnishing the surface of the copy carrier with spacers, can have, on the one hand, an adverse effect on the flow of copies, and, on the other hand, a measure of this nature requires the additional provision of a special copy carrier material.

In order to obtain trouble-free print transfer, it is also known to provide the surfaces of photoconductive coatings with a smooth finish (German Offenlegungsschrift No. 2,938,944; German Offenlegungsschrift No. 3,006,962). On such surfaces, the roughness depths must be smaller than 0.5 $\mu$m, because defects which would produce visible printing faults are avoided only in this way. The surfaces of photoconductive coatings are smoothed by a brief surface melting treatment, carried out, for example, by irradiation with electrons, or by means of a thermal treatment under an increased external pressure, or by removing material from the surface by chemical or electrochemical means. The known processes for smoothing the surfaces of charge image carriers involve considerable effort and require significant additional costs.

The object of the present invention accordingly is to avoid, in an electrophotographic recording process comprising the use of a liquid developer and transfer of the deposited toner image, the adverse drag-out of dispersing liquid, which process, however, simultaneously guarantees good full-tone development and half-tone reproduction, accompanied by good resolution, and to provide photoconductive coatings which are suitable for use in this process.

This object is achieved by a process, starting from an electrophotographic recording process of the type initially cited, wherein a photoconductive coating which has undergone a surface texturing treatment is used. The surface of the photoconductive coating possesses a peak-to-valley roughness of 5 to 75 $\mu$m, preferably of 5 to 50 $\mu$m, with repetition lengths in the range from 100 to 3000 $\mu$m. It is possible to produce a textured surface of this type, in an advantageous manner, by a treatment wherein the texturing of the smooth photoconductive coating is effected by means of pressure and heat.

It has been found that the use of photoconductive coatings possessing textured surfaces enables the drag-out of dispersing liquid to be markedly reduced, by as much as half or more, accompanied by good development. No disadvantages arise during the subsequent cleaning operation. It was completely surprising that such a result could be obtained, in contradiction to the general teaching which points to extremely smooth photoconductive surfaces.

Photoconductive coatings, applied to metallic coating carriers, such as a coating applied to a drum made, for example of aluminum can be textured, according to the invention, by a process wherein material is initially removed from the metallic surface by mechanical means, after which the photoconductive coating is applied, from a solution or dispersion, and dried. This process leads to corresponding textures on the photoconductor surface, in the form, for example, of grooves or small shallow depressions. Photoconductive coatings applied to a belt type carrier can be surface textured by a process wherein the carrier belt, for example a thin sheet of polyester, is initially embossed, in accordance with known processes, as disclosed, for example, in U.S. Pat. No. 4,259,285, after which aluminum is vapor deposited onto the surface, the photoconductive coating is applied and the coating is then dried. In this case, the embossed texture of the carrier belt produces an effect on the surface of the photoconductive coating. It is also possible to remove material from the smooth surface layer which is produced on photoconductive material, removal being effected by mechanical means, or the photoconductive coating also can be subjected to an embossing process. It is also possible to achieve a textured surface on a photoconductive coating by adding functionally inert texturing elements to the solution or dispersion containing the photoconductive coating material, such as dispersions of pigments or polymers possessing a predetermined particle size. Photoconductive coatings employing an inorganic photoconductor, such as selenium or, preferably, alloys of selenium, have proved successful, as have coatings composed of organic materials.

The invention will be further illustrated by reference to the accompanying drawings, in which:

FIG. 1 shows a portion of a photoconductive drum, with an aluminum carrier 1, which is provided, on its surface, with texturing elements 2 and with a photoconductive coating 3 which exhibits texturing elements 4, in the shape of raised regions and depressed regions, identical to those of the aluminum surface, FIG. 2 diagrammatically reproduces the texturing of the surface of a smooth photoconductive coating, FIG. 3 indicates the sharp edges of a surface texture resulting from a texturing treatment, and FIG. 4 indicates how edges, as in FIG. 3, can be avoided.

In order to produce a photoconductive coating having a textured surface, the carrier 1, for example an aluminum drum, is provided, in a prior operation, for example by removing material by mechanical means, with texturing elements 2, in the shape of raised regions and depressed regions, in a manner such that, acting through the photoconductive coating 3 which is applied, these texturing elements 2 produce textures 4 on the photoconductor surface (FIG. 1). The mechanical removal of carrier material can be effected by surface milling, or by etching, or material can be added by the spot-wise application of electrically conducting substances. In the case of photoconductive belts, the thin sheets of carrier material, composed, for example, of polyester, as coating carriers, are surface milled, or are embossed, after which they are subjected to a vapor deposition treatment employing a metal, for example aluminum. The photoconductive coating 3 is applied by a vacuum evaporation method, employing, for example, selenium, or by the application, which may be continuous or intermittent, of a solution, for example, by spray coating. Thus, a surface textured photoconductive coating was produced, on an aluminum drum, by dipping it into a 10 percent concentration coating solution composed of equal parts, by weight, of poly-N-vinylcarbazole and trinitrofluorenone in tetrahydrofuran and drawing it out slowly, at a drawing speed of 40 cm per minute. The textures 4 in the glossy photoconductor coating corresponded to the texture elements 2 on the aluminum drum.

In order to apply textures to photoconductor surfaces, it is also possible, according to the invention, to start from photoconductor surfaces which are initially smooth, into which textures are introduced, for example, by removing material mechanically. In experiments of this type, it has been found, in a surprising manner, that it is possible to apply textures to photoconductive drums of types which are commonly marketed, employing selenium or alloys of selenium in a simple treatment which is effected by pressure and heat, this possibility greatly facilitating the implementation of the invention under practical conditions. In the case of photoconductive belts, it is possible to emboss the surface of the photoconductive coating, which is intrinsically smooth, in presses.

The difficult problem, which arises in the case of treatments of the above-mentioned type, namely to exert a pressure which is uniform in all directions on, for example, a coating carrier in the form of a drum, is solved with the aid of flexible, shrinkable tubing, for example flexible tubing made of a polyester, such as polyethylene terephthalate. Upon being warmed, flexible tubing of this type contracts, thereby exerting considerable force. This tubing is commercially obtainable, and is marketed in various diameters. An appropriate production procedure is shown in FIG. 2.

As shown in that Figure, an aluminum drum 1, 12 cm in diameter, carrying a photoconductive coating 3, of selenium/tellurium, was first covered, in each case, with one layer of an embossing matrix 5, with various screen printing fabrics being employed in the present case, after which it was tightly covered with a piece of shrinkable tubing 6, having a diameter of approximately 120 mm and with a film thickness of approximately 20 μm. After keeping the complete assembly for approximately 3 minutes in a drying cupboard, at 150° C., during which the temperature of the aluminum coating carrier rose to approximately 60° C., the first impression appeared on the selenium/tellurium surface. The longest period at temperature which could be allowed without adversely affecting the photoconductive properties was 5 minutes, corresponding to a temperature of approximately 75° C. in the aluminum coating carrier. The impressions were deeper after a longer baking time. By grading the baking times, it was even possible to grade the impressions in a corresponding manner, so that a set of surface textured photoconductive drums with different impression depths and different texture repetition lengths were available for testing, these tests being related to copying technology. After removing the flexible tubing 6 and the embossing matrix 5, the photoconductive drums could be installed in a commercially available copier, and could be used for producing copies. In the case of a drum possessing a well developed structure, corresponding to a roughness height between peaks and valleys of approximately 45 μm and a repetition length of approximately 110 μm, only 0.055 g of dispersing liquid was dragged out, per DIN A 4 copy, this liquid being an aliphatic hydrocarbon with a boiling point range of 180°-230° C. In comparison, using a conventional roller, with a smooth surface, the drag-out was 0.120 g per DIN A 4 copy, for copies having the same contrast, that is to say the texturing of the photoconductor surface reduced the drag-out of dispersing liquid by 54%. It was surprising that the process steps involving electrostatic charging, exposure, cleaning by means of a roller made of a foamed material, and by means of a wiper blade, and removal of residual charges, were not adversely affected to a detectable extent.

Upon examination under a magnifying lens, the image points, for example the lines on copies which had been produced with the aid of the surface textured photoconductive drum possessing peak-to-valley roughness values in excess of 20 μm, exhibited a texture which was either formed by spots, or which was drop-like in nature. The raised regions, produced by texturing the photoconductor surface, are believed to act as spacers. In the case of photoconductor surfaces with peak-to-valley roughness values of less than 20 μm, these spot-wise or drop-like textures could not be obtained on the copies, although the drag-out of liquid was reduced by an almost comparable amount.

At the present time, these processes are capable of explanation only to the extent that, when the surface textures are comparatively coarse, the images, composed of drops, are created by the transfer of toner across an air-gap, which establishes itself at a size corresponding approximately to the peak-to-valley roughness values. The mechanism whereby the drag-out of dispersing liquid is reduced by textures having roughness values of less than approximately 20 μm is still unexplained.

The recording process according to the invention therefore can be adjusted in a manner such that it is possible both to obtain copies with image points possessing a spot-wise or drop-like texture, and copies with image points which are composed of a uniform deposit of pigment, accompanied, at the same time, by comparable reductions in the drag-out of dispersing liquid.

A treatment to produce textured surfaces on photoconductive coatings containing a monomeric or polymeric organic photoconductor, employing the shrinkable tubing technique, as described, can be carried out at temperatures in the range of 60° to 120° C.

The texturing technique employing shrinkable tubing is capable of great variation, for it is possible to produce textures of different shapes, depending upon the matrix which is inserted. For example, the textures can exhibit sharp-edged shapes 7, as indicated in FIG. 3, such textures having been produced with the aid of the screen printing fabric 5 previously mentioned. They can produce fine pigment patterns on the copy carrier, at image-free points, such patterns being undesired. It has proved expedient to prevent the formation of sharp edges by a technique wherein an intermediate film 8, which has a smoothing action, is inserted between the screen printing fabric 5 and the photoconductive coating 3, as shown by FIG. 4, the intermediate film in this case being a polyester film with a thickness of 10 μm, and being, for example, thinner than the film of which the shrinkable tubing is composed. A texture possessing a substantially sinusoidal cross-section is then obtained. A photoconductive drum which has received a wavy texture of this type produces copies which are free of background to a surprisingly good degree, and which, in themselves, exbibit very uniform full-tone and half-tone areas and a good, undiminished, resolution of 6.3 lines/mm. Upon examination under a magnifying lens, the copies exhibit substantially uniform pigment deposition in the image areas. The measured drag-out of dispersing liquid was 0.070 g per DIN A 4 copy.

The peak-to-valley roughness of the photoconductor surface employed to produce the above copies was approximately 6 μm. Similar results were obtained, even when the repetition lengths of the textures varied between 110 μm and 700 μm.

The use of the photoconductor surfaces which have undergone a texturing treatment according to the invention, additionally has the following advantage:

Upon copying onto smooth, non-absorbent copy carriers, such as polyester films, the copies were somewhat smeared, and hence lacking in sharpness, when employing conventional photoconductive coatings with smooth surfaces. Upon copying with photoconductive coatings which had been surface textured in accordance with the invention, it was possible, even under these conditions, to produce sharp copies. It is believed that this can be attributed to the point-wise or drop-wise manner in which the image points are generated.

Furthermore, a photoconductive coating having a surface texture was obtained by incorporating texturing elements into the photoconductive coating itself. For example, the 10 percent concentration coating solution, composed of equal parts by weight of poly-N-vinylcarbazole and trinitrofluorenone, was prepared in a dispersion of 3 percent of polytetrafluoroethylene in tetrahydrofuran. For this purpose, the particles, supplied in an aqueous dispersion, previously had been washed several times in tetrahydrofuran and possessed diameters ranging up to 60 μm. The photoconductive coating, on a coating carrier in the form of a polyester film, 50 μm thick, with a vapor deposited aluminum layer, exhibited spherical bumps on its surface, its thickness being 9 μm in the dry state. In order to produce copies in a copier, the photoconductive strip was stretched around a drum, negatively charged to approximately 950 V, exposed, and developed by means of toner liquid, the latter containing positive charged pigment particles. The copies were free of background, and only upon careful examination under a magnifying lens did the image-free points reveal faint, spot-shaped toner deposits, these deposits corresponding to the surface texture. The drag-out, by the copies, of the liquid aliphatic hydrocarbon used as the dispersing liquid was 0.068 g per DIN A 4 copy. A drag-out of 0.115 g per DIN A 4 copy is otherwise measured when using photoconductive coatings with smooth surfaces.

It will be obvious to those skilled in the art that many modifications may be made within the scope of the present invention without departing from the spirit thereof, and the invention includes all such modifications.

What we claim is:

1. A method for recording electrophotographically an image on a copy carrier by using a liquid developer, comprising the steps of:

electrostatically charging and exposing a photoconductive coating in a manner whereby a charge image is generated thereon;

rendering visible said charge image as a toner image by means of a liquid developer, said developer containing dispersing liquid for the toner; and transferring and fixing said toner image to a copy carrier;

wherein said photoconductive coating is deposited on a carrier and has a texture pattern with a surface roughness of from about 5 μm to about 50 μm and repetition lengths of from about 100 μm to about 3000 μm, said texture pattern reducing the drag-out of dispersing liquid;

wherein said carrier of the photoconductive coating is provided with texturing elements by mechanical removal, embossing, etching or spot-wise application of electrically conducting substances, said texturing elements producing textures on the photoconductive coating applied to the surface of the carrier, the texture patterns having a substantially sinusoidal cross-section; and wherein the texture pattern is produced on the photoconductive coating by a shrinkable flexible tubing with an inserted embossing matrix of a screen printing fabric, drawn tightly over the photoconductive coating, and heated to a temperature sufficient to cause shrinkage of the tubing.

2. A method for recording electrophotographically as claimed in claim 1, wherein an intermediate film is inserted between the embossing matrix and the photoconductive coating.

3. A method for recording electrophotographically as claimed in claim 2, wherein the flexible tubing is heated to a temperature of from about 60° C. to about 120° C. for a period of from about 3 to about 5 minutes, and wherein the drag-out of dispersing liquid is reduced up to about 59% as compared to a smooth, non-textured photoconductive coating.

* * * * *